US005435798A

United States Patent [19]

Habing et al.

[11] Patent Number: 5,435,798

[45] Date of Patent: Jul. 25, 1995

[54] EXERCISE APPARATUS WITH ELECTRONICALLY VARIABLE RESISTANCE

[75] Inventors: Theodore G. Habing, Long Beach; Douglas J. Habing, Manhattan Beach; Harvey Goodman, Huntington Beach, all of Calif.

[73] Assignee: Pacific Fitness Corporation, Cypress, Calif.

[21] Appl. No.: 107,951

[22] Filed: Aug. 17, 1993

[51] Int. Cl.[6] ..... A63B 21/005

[52] U.S. Cl. ..... 482/5; 482/94; 482/903; 73/379.01

[58] Field of Search ..... 482/4–7, 482/45, 91–94, 97–102, 106, 108, 110, 114, 115, 120, 121, 129, 900, 903, 904, 906; 601/23, 33, 40; 73/379.01, 379.08

[56] References Cited

U.S. PATENT DOCUMENTS

| | | | |
|---|---|---|---|
| 3,171,652 | 3/1965 | Newman | 482/106 |
| 3,573,865 | 4/1971 | Annas et al. . | |
| 4,569,518 | 2/1986 | Fulks . | |
| 4,650,185 | 3/1987 | Cartwright . | |
| 4,657,246 | 4/1987 | Salyer | 482/94 |
| 4,709,919 | 12/1987 | Cano | 482/101 |
| 4,726,582 | 2/1988 | Fulks . | |
| 4,750,738 | 6/1988 | Dang | 482/5 |
| 4,765,613 | 8/1988 | Voris | 482/5 |
| 4,822,036 | 4/1989 | Dang | 482/6 |
| 4,842,274 | 6/1989 | Oosthuizen et al. | 482/5 |
| 4,869,497 | 9/1989 | Stewart et al. . | |
| 4,884,801 | 12/1989 | Schnell . | |
| 4,921,244 | 5/1990 | Berroth | 482/94 X |
| 4,930,770 | 6/1990 | Baker . | |
| 4,998,721 | 3/1991 | Anders et al. | 482/4 |
| 5,015,926 | 5/1991 | Casler . | |
| 5,020,794 | 6/1991 | Englehardt et al. . | |

*Primary Examiner*—Joe H. Cheng

*Attorney, Agent, or Firm*—Blakely, Sokoloff, Taylor & Zafman

[57] ABSTRACT

A resistance exercise apparatus employs a suspended weight as the primary source of resistance. A variable torque drive system is coupled to the suspended weight to selectively alter the amount of resistance experienced by the user. In one embodiment, the suspended weight is a single mass corresponding to the maximum resistance of the system. During the forward or "positive" stroke of an exercise, the drive system assists the user in lifting the mass, the amount of assistance being determined by a user selectable resistance value. During the return or "negative" stroke of the exercise, a reduced level of assistance may be provided so that increased negative resistance is experienced.

31 Claims, 2 Drawing Sheets

EXERCISE APPARATUS WITH ELECTRONICALLY VARIABLE RESISTANCE

BACKGROUND OF THE INVENTION

1. Field of the Invention

This invention relates generally to the field of exercise equipment, and particularly to an apparatus for varying the amount of resistance encountered by a user during different portions of a single exercise repetition.

2. Prior Art

A great variety of machines have been developed for exercising various portions of the human body. In the majority of such machines, the user exercises against a resistance created by a suspended weight. Typically, a stack of individual weights is provided so that the user may select the amount of weight, and hence the amount of resistance, for a particular exercise.

In recent years, various electromechanical resistance systems have been proposed to replace the conventional weight stack. Such systems not only dispense with the weights, but also permit electronic control of the resistance profile during an exercise routine. As an example, U.S. Pat. No. 4,726,582 issued Feb. 23, 1988 to Fulks discloses a programmable exercise system in which conventional weights are replaced by an electric motor and a variable clutch device, such as a magnetic particle clutch. A digital processor is connected to a sensor that detects the position and direction of movement of a user operated member and controls the magnitude of the torque transmitted by the clutch. The resistive force provided to the user is thus varied as a function of the location and direction of movement of the operated member.

U.S. Pat. No. 5,020,794 issued Jun. 4, 1991 to Englehardt et al. also discloses an exercise machine in which an electric motor is used to simulate a weight stack. A computer controlled servo loop compensates for friction and inertia within the system and provides for a variable resistance profile during an exercise routine.

In a similar vein, U.S. Pat. No. 5,015,926 issued May 14, 1991 to Casler discloses an electronically controlled force application mechanism for exercise machines. This mechanism includes a constant speed high torque electric drive motor coupled to a dynamic clutch, such as a magnetic particle clutch. The torque and speed of the clutch output shaft is computer controlled to regulate the resistance profile of the exercise machine.

Prior art devices such as those discussed above that entirely eliminate suspended weights in favor of electromechanical resistance have not yet been developed to the point where they give the user the same "feel" as a conventional weight machine. Nevertheless, electromechanical resistance systems are extremely versatile in terms of customizing and/or varying resistance profiles.

SUMMARY OF THE INVENTION

One of the objects of the present invention is to provide a suspended weight-resistance system for an exercise machine that incorporates many of the advantages of electromechanical resistance systems.

Another object of the present invention is to provide a weight-resistance exercise system capable of varying the resistance level and/or controlling the speed of an exercise motion in both the positive and negative directions.

A further object of the present invention is to provide an electromechanical resistance exercise apparatus with improved "feel".

Another object is to provide an electromechanical resistance exercise apparatus that may be realized with lower cost components than heretofore required.

Yet another object of the present invention is to provide an exercise resistance system in which there is increased "negative" resistance during the return stroke of an exercise.

A still further object of the present invention is to provide a variable resistance exercise system that is able to "coach" the user during the performance of an exercise by varying the level of resistance.

These and other objects of the present invention are achieved in an exercise apparatus that employs a suspended weight as the primary resistance means. A variable torque drive system is coupled to the suspended weight to selectively alter the amount of resistance experienced by the user. In one embodiment, the suspended weight comprises a single mass corresponding to the maximum resistance of the system. During the forward or "positive" stroke of an exercise, the drive system assists the user in lifting the mass, the amount of assistance being determined by a user selectable resistance value. The amount of assistance may be further varied under computer control. In particular, a reduced level of assistance may be provided during the return or "negative" stroke of the exercise so that increased negative resistance is experienced.

In an alternative embodiment of the invention, a conventional weight stack is provided as the primary resistance means. A desired resistance is selected in the conventional manner; however, the actual amount of weight is somewhat less than the desired resistance. A variable torque drive system is again provided as in the previously described embodiment to increase the total resistance to the desired level. Still greater resistance may again be provided during the return stroke of the exercise.

In another alternative embodiment of the invention, the primary resistance means comprises a single mass that is suspended from a lever arm. The effective resistance provided to the user is varied by varying the position along the lever arm of an attachment point for coupling the weight to a user operated member. As in the other embodiments, a variable torque drive system provides a computer controlled level of resistance throughout the exercise stroke.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known mechanical and electronic elements are omitted so as to not obscure the description of the present invention with unnecessary detail.

Figure 1:
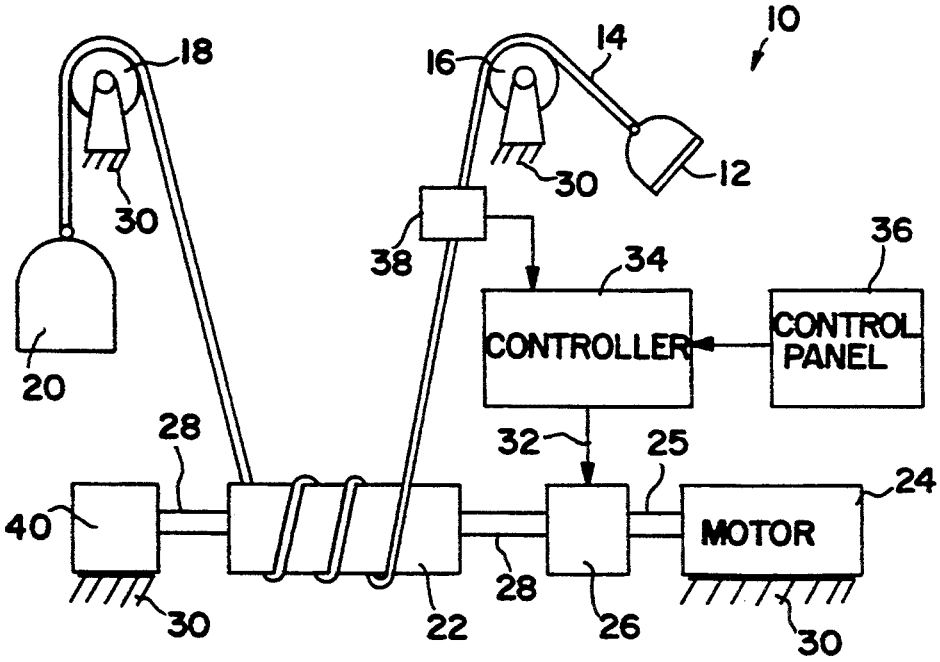
FIG. 1 is a diagrammatic illustration of a typical embodiment of the present invention.

FIG. 1 diagrammatically illustrates a typical embodiment of the present invention. An exercise apparatus 10 is provided for exercising one or more muscle groups of a user's body. Apparatus 10 may be dedicated to exercising a specific muscle or group of muscles as is the case with a wide variety of "single station" exercise machines that are now available, particularly in health clubs and the like. Alternatively, apparatus 10 may be a "multi-station" exercise machine having a number of exercise stations, each of which is configured for exercising a particular muscle group.

No matter the type of machine, apparatus 10 includes at least one operable member 12 for performing an exercise. Operable member 12 may be a simple hand grip as illustrated in FIG. 1 or may comprise a variety of other devices for interaction with the human body. Examples of such other devices include a press arm for performing chest and shoulder press exercises, a lat bar for performing pull down, push down and lat row exercises and a pec fly station for exercising the pectoral and deltoid muscles. Other types of operable members for performing additional exercises will be apparent to those of skill in the art of designing exercise machines.

Operable member 12 is coupled to a cable 14 that is guided around pulleys 16 and 18 for eventual connection to a weight 20. Pulleys 16 and 18 are rotatably mounted on the frame or structure 30 of apparatus 10. It will be recognized that operable member 12 may be coupled to weight 20 by a more or less complex system of cables and pulleys than that indicated in FIG. 1. For example, in many "multi-station" exercise machines, a single cable may be routed so as to communicate exercise resistance to a plurality of operable members. Furthermore, a plurality of cables may be interconnected in order to communicate the resistance provided by weight 20 to operable member 12. In general, the portions of apparatus 10 comprising frame 30, operable member 12, and cable and pulley system 14–18 may be identical to any of the multitude of weight resistance exercise machines that are presently on the market. Indeed, apparatus 10 may be constructed as a modification of such a machine.

In most weight resistance exercise machines, the weight comprises a stack of individual weight plates so that the amount of weight to be utilized in performing an exercise may be selected by the user. Typically, the amount of weight is selected by inserting a pin below the desired number of weight plates. Weight 20 of apparatus 10 may comprise such a stack of individual weight plates as are well known in the prior art. However, the present invention may be advantageously employed with a weight 20 that is a unitary heavy mass. For example, weight 20 may comprise a hollow vessel that is filled with a dense material, such as sand. The total mass of weight 20 preferably exceeds 200 pounds so that exercises may be performed over a wide range of resistance levels; however, any desired weight may be employed. The use of a single massive weight offers several advantages over a conventional stack of individual weight plates. First of all, if weight 20 comprises a hollow vessel, to be filled at the time of installation, the shipping weight of apparatus 10 is substantially reduced. In addition, it has proven to be difficult to maintain dimensional tolerances of conventional weight plates, thereby creating problems with alignment of the weight stack for smooth and quiet operation.

Intermediate between operable member 12 and weight 20, several revolutions of cable 14 are wrapped around drum 22. An electric motor 24 drives the input shaft 25 of a variable torque transmission device 26. Device 26 is preferably a magnetic particle clutch of the type generally described in the above-mentioned U.S. Pat. No. 5,015,926. Motor 24 may be a fixed or variable speed motor driven with either AC or DC power. In some embodiments, a high-torque DC motor may be employed to obviate the need for a variable torque transmission device. In such case, the desired level of torque is achieved by direct control of the motor current.

Drum 22 is attached to output shaft 28 of the variable torque transmission device 26. Motor 24 turns drum 22 in a direction to assist the user in lifting weight 20. Alternative means may be employed for communicating the user assistance provided by motor 24. For example, drum 22 may be replaced with a sprocket for driving engagement with a chain, toothed belt or other suitable flexible drive element in lieu of cable 14.

The output torque of device 26 is determined by control signal 32 provided by controller 34. The amount of weight resistance desired for a particular exercise may be entered on a control panel 36. Controller 34 then computes the amount of torque to be transmitted through device 26 so as to appropriately modify the resistance provided by weight 20. In the case of a unitary massive weight 20, controller 34 adjusts the magnitude of torque transmitted so as to assist the user when operating operable member 12 and thereby reduce the effective resistance provided by weight 20 to the level desired.

A sensor device 38 is preferably associated with operable member 12 to provide indications to controller 34 of the position, speed and direction of motion of the operable member. The placement of sensor 38 will naturally depend upon the particular type of operable member with which it is associated. However, numerous optical and magnetic devices are well known in the art for providing the desired indications. By providing such indications to controller 34, the resistance profile throughout the exercise stroke of operable member 12 may be precisely controlled. For example, the effective resistance provided by weight 20 may be increased during the "negative" portion of the exercise stroke relative to that provided during the "positive" portion of the stroke. Such increase may be computed as a percentage of the value of the positive resistance with the percentage being input by the user. Alternatively, the negative resistance may be gradually increased as the user holds the operable member at the outward limit of the exercise. Once the return movement of the operable member is sensed or reaches a predetermined speed, the negative resistance is then held constant. If the user stops moving the operable member during the return stroke or if the rate of movement falls below a certain speed, the negative resistance may be increased still further until return movement resumes. Conversely, if the rate of movement is too fast, the effective level of resistance may be decreased. This is a significant safety feature to prevent injury if, for example, the operable member is suddenly released during the performance of an exercise.

The amount of effective resistance provided to the user may be continuously varied in accordance with the progress of the exercise routine. In this way, the apparatus may "coach the user during performance of an exercise. For example, if isokinetic exercise is desired and an increase in speed is detected during the exercise stroke, the amount of effective resistance may be increased to maintain a preset or computed speed. Conversely, if a decrease in speed is detected, the amount of effective resistance may be reduced until the appropriate speed is regained. Virtually any resistance profile can be readily achieved with suitable programming of controller 34. For example, the torque transmitted by device 26 may be adjusted to be greater as the weight is lowered than when lifted (i.e., negative resistance less than positive resistance) or the torque can be constant in both directions (i.e., equal positive and negative resistance).

A fail-safe device 40 is coupled to shaft 28 to prevent a runaway condition. For example, in the event of a power failure, user assistance provided by motor 24 could be lost in the middle of an exercise. The user would thus be suddenly confronted with the maximum effective load of weight 20. To prevent injury, as well as damage to apparatus 10, device 40 locks or limits the speed of rotation of shaft 28. Device 40 is preferably a mechanical device such as a centrifugal latch or speed governor. However, a friction brake held normally open by a solenoid may also be included as an additional safety precaution for the particular situation of a power failure.

Instead of a single massive weight, weight 20 may be implemented as a conventional stack of weight plates. In this case, the user would select a weight for the exercise in the conventional manner. Preferably, the actual amount of the weight so selected would be somewhat less than the weight indicated by the selection. For example, if the weight plates are marked in conventional ten pound increments, the actual weight of each plate would be uniformly somewhat less than ten pounds, say eight pounds, so that the actual weight selected would be twenty percent less than the amount indicated. Additional resistance equal to the difference would then be supplied by the motor/transmission unit so that the total effective resistance encountered by the user is equal to the amount selected. In this manner, the amount of resistance can be "backed off" when appropriate during the course of the exercise by controller 34. As mentioned above, such a reduction in resistance may be desirable during the forward stroke of an exercise if the rate of movement of the exercise member falls below a set speed. The effective resistance for the negative stroke of the exercise may be increased still further by the operation of motor 24 and torque transmission device 26 as previously discussed.

Figure 2:
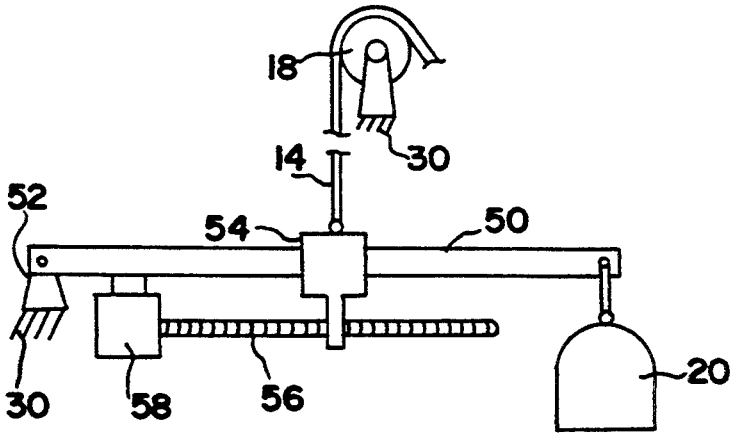
FIG. 2 is a partial diagrammatic illustration of an alternative embodiment of the present invention.

FIG. 2 partially illustrates an alternative embodiment of the present invention similar to that previously described. However, in this embodiment, cable 14 is not directly attached to weight 20. Instead, weight 20 is suspended from lever arm 50 which is pivotally attached to frame 30 at fulcrum 52. Cable 14 is attached to slide member 54 which rides along the center portion of lever arm 50. Cable 14 continues to the remainder of the apparatus as illustrated in FIG. 1. Weight 20 is preferably a unitary mass and the effective amount of resistance provided by the weight is adjusted according to the position of slide member 54 on lever arm 50. The effective resistance provided to the user is further modified in the manner previously described by means of motor 24 and variable torque transmission device 26.

Slide member 54 may be manually positioned along lever arm 50; however, adjustment is more conveniently achieved with a jack screw 56 driven by motor 58. This not only allows convenient selection of the desired level of effective resistance from control panel 36, but also permits coarse adjustments to the level of resistance to be made by controller 34. Such adjustments may, for example, be pre-programmed by the user to provide different resistance levels for successive "sets" of exercise repetitions. The primary control of the resistance profile during an exercise stroke would still be provided by control of the variable torque transmission device.

Figure 3:
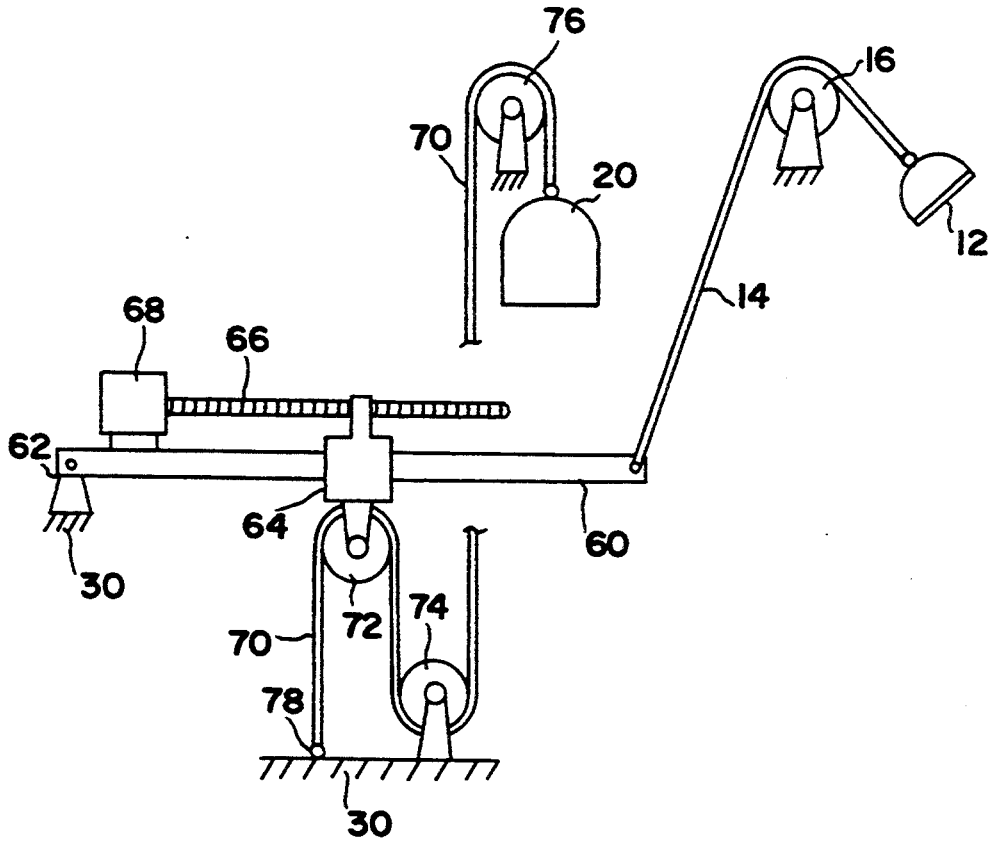
FIG. 3 is a partial diagrammatic illustration of another alternative embodiment of the present invention.

FIG. 3 partially illustrates another embodiment of the present invention similar to the one just discussed. In this case, cable 14 is attached to the end of lever arm 60, which is supported at fulcrum 62. A sliding member 64 is positionable along the length of lever arm 60. The location of sliding member 64 may be adjusted manually or, as in the previously described embodiment, sliding member 64 may be positioned by means of a jack screw 66 driven by motor 68.

Weight 20 is suspended from cable 70 which is routed around pulley 72 mounted on sliding member 64 and also around pulleys 74 and 76. The end of cable 70 is attached to frame 30 with a shackle or other suitable means 78. It will be understood that cable 70 is also routed around a resistance modifying means (not shown in FIG. 3) as in the first described embodiment. Numerous variations of the rigging illustrated in FIG. 3 may be employed. For example, cable 70 may be directly attached to sliding member 64. Further alternative embodiments are possible within the scope of this invention. For example, the weight and operable member may be coupled to opposite ends of the lever arm and the location of the fulcrum point may be made adjustable.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

I claim:

1. An exercise apparatus comprising:

an operable member for engagement by a user of the apparatus to exercise a part of the user's body;

means for selecting and providing a desired exercise resistance;

a weight for providing a maximum exercise resistance in excess of the desired exercise resistance;

means for coupling the weight to the operable member so that movement of the operable member in a first direction lifts the weight and movement of the operable member in a second direction, opposite the first direction, lowers the weight;

means for providing a first amount of assistance to the user in lifting the weight as the operable member is moved in the first direction so as to provide an effective exercise resistance equal to the desired exercise resistance.

2. The apparatus of claim 1 wherein the means for providing the first amount of assistance further provides a second amount of assistance to the user as the operable member is moved in the second direction.

3. The apparatus of claim 2 wherein the first and second amounts of assistance are different.

4. The apparatus of claim 3 wherein the first amount of assistance is greater than the second amount of assistance.

5. The apparatus of claim 1 wherein the means for coupling comprises a cable and pulley system.

6. The apparatus of claim 1 wherein the means for providing user assistance comprises an electric motor.

7. The apparatus of claim 6 wherein the means for providing user assistance further comprises a variable torque transmission device.

8. The apparatus of claim 7 wherein the variable torque transmission device is a magnetic particle clutch.

9. The apparatus of claim 1 wherein the weight is a unitary mass.

10. The apparatus of claim 9 wherein the weight comprises a hollow vessel filled with a dense material.

11. The apparatus of claim 1 wherein the weight comprises a stack of individual weight plates.

12. An exercise apparatus comprising:

an operable member for engagement by a user of the apparatus to exercise a part of the user's body;

means for selecting and providing a desired exercise resistance;

a weight for providing a maximum exercise resistance in excess of the desired exercise resistance;

flexible weight coupling means for coupling the weight to the operable member;

a rotatable member having the flexible weight coupling means wrapped around at least a portion of a perimeter thereof for driving engagement therewith;

a motor;

means for transmitting an adjustable magnitude of torque from the motor to the rotatable member so as to provide an effective exercise resistance equal to the desired exercise resistance.

13. The apparatus of claim 12 further comprising means for sensing a direction of movement of the operable member.

14. The apparatus of claim 13 wherein the torque transmitting means transmits a first magnitude of torque when the operable member is moving in a first direction and a second magnitude of torque when the operable member is moving in a second direction, opposite to the first.

15. The apparatus of claim 14 wherein the weight is lifted when the operable member is moving in the first direction and is lowered when the operable member is moving in the second direction and wherein the first magnitude of torque is greater than the second magnitude of torque.

16. The apparatus of claim 14 wherein the weight is lifted when the operable member is moving in the first direction and is lowered when the operable member is moving in the second direction and wherein the first magnitude of torque is less than the second magnitude of torque.

17. The apparatus of claim 14 wherein the weight is lifted when the operable member is moving in the first direction and is lowered when the operable member is moving in the second direction and wherein the first and second magnitudes of torque are equal.

18. The apparatus of claim 12 wherein the torque transmitting means comprises a magnetic particle clutch.

19. The apparatus of claim 12 wherein the weight is a unitary mass.

20. The apparatus of claim 19 wherein the weight comprises a hollow vessel filled with a dense material.

21. The apparatus of claim 12 wherein the weight comprises a stack of individual weight plates.

22. An exercise apparatus comprising:

an operable member for engagement by a user of the apparatus to exercise a part of the user's body;

means for selecting and providing a desired exercise resistance:

a weight for providing a maximum exercise resistance in excess of the desired exercise resistance;

means for coupling the weight to the operable member;

means coupled to the operable member for reducing the maximum exercise resistance to an effective exercise resistance equal to the desired exercise resistance in at least one direction of travel of the operable member;

means coupled to the operable member for sensing movement thereof;

resistance modifying means coupled to the operable member for modifying the effective exercise resistance;

control means coupled to the sensing means for controlling the resistance modifying means so that the effective exercise resistance is modified as a function of the movement of the operable member.

23. The apparatus of claim 22 wherein the weight is lifted when the operable member is moving in the first direction and is lowered when the operable member is moving in the second direction and wherein the resistance modifying means provides a first modifying resistance when the operable member is moving in the first direction and a second modifying resistance when the operable member is moving in the second direction.

24. The apparatus of claim 23 wherein the first modifying resistance reduces the effective exercise resistance.

25. The apparatus of claim 24 wherein the second modifying resistance reduces the effective exercise resistance by an amount less than the first modifying resistance.

26. The apparatus of claim 23 wherein the first modifying resistance increases the effective exercise resistance above the desired exercise resistance.

27. The apparatus of claim 26 wherein the second modifying resistance increases the effective exercise resistance by an amount greater than the first modifying resistance.

28. The apparatus of claim 22 wherein the weight is a unitary mass.

29. The apparatus of claim 28 wherein the weight comprises a hollow vessel filled with a dense material.

30. The apparatus of claim 22 wherein the weight comprises a stack of individual weight plates.

31. The apparatus of claim 22 wherein the resistance modifying means comprises a motor and means for transmitting an adjustable magnitude of torque from the motor to the operable member.

* * * * *